US005922501A

United States Patent [19]

Cheng et al.

[11] Patent Number: 5,922,501

[45] Date of Patent: Jul. 13, 1999

[54] TONER PROCESSES

[75] Inventors: Chieh-Min Cheng, Rochester; Grazyna E. Kmiecik-Lawrynowicz, Fairport; Karen L. LaMora, Marion; Casimir J. Mytych, Rochester, all of N.Y.

[73] Assignee: Xerox Corporation, Stamford, Conn.

[21] Appl. No.: 09/208,792

[22] Filed: Dec. 10, 1998

[51] Int. Cl.[6] ..... G03G 9/87

[52] U.S. Cl. ..... 430/137; 430/109

[58] Field of Search ..... 430/109, 137

[56] References Cited

U.S. PATENT DOCUMENTS

| | | | |
|---|---|---|---|
| 4,265,993 | 5/1981 | Kawanishi et al. | 430/109 |
| 4,558,108 | 12/1985 | Alexandru et al. | 526/340 |
| 4,797,339 | 1/1989 | Maruyama et al. | 430/109 |
| 4,869,990 | 9/1989 | Hosoi | 430/137 |
| 4,983,488 | 1/1991 | Tan et al. | 430/137 |
| 4,996,127 | 2/1991 | Hasegawa et al. | 430/109 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/137 |
| 5,650,255 | 7/1997 | Ng et al. | 430/137 |
| 5,650,256 | 7/1997 | Veregin et al. | 430/137 |
| 5,812,911 | 9/1998 | Asanae | 399/130 |
| 5,827,633 | 10/1998 | Ong et al. | 430/137 |

*Primary Examiner*—Roland Martin
*Attorney, Agent, or Firm*—E. O. Palazzo

[57] ABSTRACT

A process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying.

32 Claims, No Drawings

TONER PROCESSES

PATENTS AND PENDING APPLICATIONS

Illustrated in U.S. Pat. No. 5,827,633, the disclosure of which is totally incorporated herein by reference, is a process for the preparation of toner which process comprises, for example, (i) preparing, or providing an aqueous colorant dispersion, which dispersion is comprised of a colorant and an ionic surfactant in water;

(ii) blending the colorant dispersion with a latex emulsion comprised of resin particles, a nonionic surfactant, and an ionic surfactant of opposite charge polarity to that of the ionic surfactant in the colorant dispersion;

(iii) heating the resulting mixture below about the glass transition temperature (Tg) of the latex resin to form toner sized aggregates;

(iv) heating the resulting aggregate suspension of (iii) above about the Tg of the latex resin; and (v) retaining the temperature in the range of from about 30° C. to about 95° C., and subsequently, adding an aqueous solution of boric acid, or an aqueous solution of a metal salt; adjusting the pH of the resulting reaction mixture to from about 9 to about 12 by the addition of a base, followed by the addition of a salicylic acid or catechol; and optionally (vi) isolating, washing and drying the toner obtained.

In copending application U.S. Ser. No. 08/922,437, the disclosure of which is totally incorporated herein by reference, there is, illustrated for example, a process for the preparation of toner comprising (i) aggregating with a metal complex, or metal ion a colorant dispersion with a latex emulsion and optional additives to form aggregates;

(ii) coalescing or fusing said aggregates; and optionally (iii) isolating, washing, and drying the toner.

The following copending applications, the disclosures of which are totally incorporated herein by reference, are also directed to other processes.

U.S. Ser. No. 09/006,622 discloses a toner process wherein a colorant is flushed into a sulfonated polyester, followed by the addition of an organic soluble dye and an alkali halide solution.

U.S. Ser. No. 09/006,612 discloses a toner process with a first aggregation of sulfonated polyester, and thereafter, a second aggregation with a colorant dispersion and an alkali halide.

U.S. Ser. No. 09/006,640 discloses a toner process wherein a latex emulsion and a colorant dispersion are mixed in the presence of an organic complexing agent or compound, and wherein the latex can contain a sodio sulfonated polyester resin.

U.S. Ser. No. 09/006,521 discloses an emulsion/aggregation/fusing process for the preparation of a toner containing a resin derived from the polymerization of styrene butadiene, acrylonitrile, and acrylic acid.

U.S. Ser. No. 09/006,553 discloses a toner process wherein there is mixed an emulsion latex, a colorant dispersion, and a monocationic salt, and wherein the resulting mixture possesses an ionic strength of about 0.001 molar to about 5 molar.

U.S. Ser. No. 09/006,299 discloses a toner process wherein there is mixed an emulsion latex and colorant dispersion, and wherein the colorant dispersion is stabilized with submicron sodio sulfonated polyester resin particles, and wherein the latex resin can be a sodio sulfonated polyester.

U.S. Ser. No. 09/006,508 discloses a toner process by blending an aqueous colorant dispersion with a latex blend containing a linear polymer and soft crosslinked polymer particles.

The appropriate components and processes of the above patent and copending applications may be selected for toner and processes of the present invention in embodiments thereof.

BACKGROUND OF THE INVENTION

The present invention is generally directed to toner processes, and more specifically, to chemical in situ processes which comprises the aggregation and fusion of latex, colorant, and optional additive particles into toner particles, and wherein there is selected a latex containing a dimeric component, an oligomeric component, or mixtures thereof. More specifically, the present invention relates to toners and processes thereof wherein there is selected for the latex a dimeric acrylic acid, an oligomeric acrylic acid, or mixtures thereof, and yet more specifically, a dimeric acrylic acid containing carboxylic acid groups, or an oligomeric acrylic acid containing carboxylic acid groups. The toner compositions resulting possess, for example, a volume average diameter of from about 1 to about 25 microns, and preferably from about 3 to about 10 microns in volume average diameter, with a narrow particle size distribution as conventionally characterized by GSD of, for example, less than 1.35, and preferably less than about 1.25, and more specifically, from about 1.12 to about 1.25 as measured on the Coulter Counter, and which toners can enable improved image fusing, that is for example, fusing of the image can be accomplished at a low temperature, for example, with a toner Minimum Fix Temperature (MFT) of from about 150° C. to about 170° C., as compared to toners prepared ) from latexes with monomeric acrylic acid, which toners possess a MFT of from about 180° C. to about 200° C., and wherein the invention toners possess excellent triboelectrical charging characteristics with a toner tribo of from about 20 $\mu$C/gram to about 40 $\mu$C/gram (microcoulombs per gram) at 50 percent relative humidity, as compared, for example, to toners prepared from latexes with monomeric acrylic acid that possess in a number of instances a low toner tribo of from about 10 $\mu$C/gram to about 15 $\mu$C/gram at 50 percent relative humidity; and acceptable gloss, for example with a gloss of from 20 GSU (Gardner Gloss Units) up to 70 GCU as measured by Gardner Gloss meter matching of the toner and paper after fixing the toner to paper substrates. The resulting toners can be selected for known electrophotographic imaging and printing processes, including digital color processes.

The dimers and oligomers selected, which are available from a number of sources, can be considered alkenoic acids, that is for example, olefinically unsaturated carboxy functional monomers of, for example, alpha, beta-ethylenically unsaturated carboxylic acids, preferably of the formula

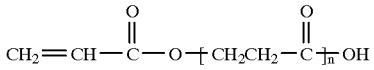

wherein n is a number of from about 1 to about 20, and preferably from about 1 to about 13, and more preferably of from 1 to about 5; (about, and between include all values therebetween throughout). These acids can be prepared conveniently by the Michael addition reaction of acrylic acid with itself, the degree of addition primarily determining the value of n. The acid molecule where n equals to 1 is also known as diacrylic acid, β-acryloxypropionic acid, or β-carboxyethyl acrylate of the formula

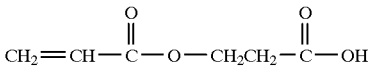

The degree of polymerization is conveniently characterized by the average value n, thus for example samples of the oligomer, or dimer will normally have a low degree of polymerization, and wherein the oligomers, are, for example, comprised of mixtures of individual molecules with the formulas illustrated herein. For an individual molecule, such as dimer, trimer, tetramer, or higher mers, n is preferably an integer or number of, for example, about 2 to about 20. The oligomer acrylic possesses, for example, an n value of from about 2 to about 20, and preferably from about 2 to about 13, and more preferably from 2 to about 5, and the $M_w$ weight average molecular weight, of the oligomer acrylic acid is, for example, from about 200 to about 3,500, and preferably from about 200 to about 2,500, and the $M_n$ thereof is, for example, preferably from about 200 to about 1,500, and more preferably from about 200 to about 1,000, as determined by Gel Permeation Chromatography. The dimer can be considered as being the reaction product of two acrylic acid monomers, and wherein n is preferably equal to 1. The molecular weight for a dimer is, for example, about (the dimer is a believed to be the reaction product of two acrylic acid monomers, and no mixture is present) 144 grams/mole.

Acryloxypropionic acid and higher oligomeric homologues, which higher is, for example, a $M_w$ of from about 200 to about 3,500, can be prepared by any of a variety of methods including (1) the addition of acrylic acid to β-propiolactone; (2) the reaction of acrylic acid or acryloyl chloride with 3-hydroxypropionic acid, or the (3) thermal dimerization/oligomerization of acrylic acid either with or without added catalysts. For example, β-acryloxypropionic acid can be prepared by the dimerization of acrylic acid by the known Michael addition reaction promoted by triphenylphosphine. The dimerization in bulk acrylic acid results from the electrophilic addition of one acrylic acid molecule across the vinyl bond of a second acrylic acid to form an ester group. β-acryloxypropionic acid can also be generated by heating acrylic acid at about 150° C. to about 160° C. in the presence of a catalytic amount of aluminum trichloride. β-Acryloxypropionic acid molecules can undergo subsequent Michael additions with other acrylic acid molecules to form higher molecular-weight oligomers, which possess an $M_w$ of from about 200 to about 3,500. Also, β-acryloxypropionic acid is preferably admixed in varying proportions with the higher oligomeric homologues. The acid(s) selected are usually of commercial grade and therefore contain small quantities of acrylic acid of from about 5 to about 20 weight percent.

PRIOR ART

In xerographic systems, especially color systems, small sized toners of preferably from about 2 to about 10 microns are important to the achievement of high image quality for process color applications. It is also important to generate a low image pile height to eliminate, or minimize image feel and avoid paper curling after fusing. Paper curling can be particularly pronounced in xerographic color processes primarily because of the presence of relatively high toner coverage as a result of the application of three to four color toners. During the fusing step, moisture is driven off from the paper due to high fusing temperatures of from about 120° C. to 200° C. In the situation wherein with only one layer of toner is selected, such as in one-color black or highlight color xerographic applications, the amount of moisture driven off during fusing can be reabsorbed by the paper and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes of the present invention.

It is preferable to use small toner particle sizes, such as from about 2 to about 7 microns, and with high colorant, especially pigment loading, such as from about 4 to about 15 percent by weight of toner, thus the mass of toner necessary for attaining the required optical density and color gamut can be significantly reduced to eliminate or minimize paper curl. Lower toner mass also ensures the achievement of image uniformity. However, higher pigment loadings often adversely affect the charging behavior of toners. For example, the toner charge levels may be too low for toner development or the charge distributions may be too wide and toners of wrong charge polarity may be present. Furthermore, higher pigment loadings may also result in charging behavior charges. Toners prepared in accordance with the processes of the present invention minimize, or avoid these disadvantages.

Numerous processes are known for toner preparation, such as, for example, conventional processes wherein a resin is melt blended or extruded with a pigment, micronized and pulverized to provide toner particles. The toner average volume particle diameter which can be cost effectively produced by conventional processes are generally over 8 or 9 microns with a typical GSD of over 1.4. In these conventional processes, it is, therefore, important to subject the toners to a size classification to achieve a decreased GSD to a more acceptable level of, for example, about 1.35 to thereby provide reasonable image quality. In general, two or three classification cycles may be required, and the toner yields after classification can range from about 40 percent to about 90 percent depending on the toner size and GSD requirements. Generally, for toners with average particle size diameters of from about 11 microns to about 15 microns, toner yields range from about 70 percent to about 85 percent after classification. For smaller sized toners, such as about 7 or 8 micron toners, lower yields of about 50 to 80 percent can result after classification. With the processes of the present invention in embodiments, small toner sizes of, for example, from about 2 to about 10 microns, and a GSD of less than about 1.35, and more specifically, less than about 1.25 can be obtained without classification processes. Since no or minimum classification is needed with the processes of the present invention, in embodiments small toners of from about 2 microns to about 7 microns can be economically prepared in yields of about 90 percent, or greater.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles are obtained. In U.S. Pat. No. 4,797,339, there is disclosed a process for the preparation of toners by resin emulsion polymerization, wherein similar to the '127 patent certain polar resins are selected; and U.S. Pat. No. 4,558,108, discloses a process for the preparation of a copolymer of styrene and butadiene by specific suspension polymerization. Other prior art that may be of interest includes U.S. Pat. Nos. 3,674,736; 4,137,188 and 5,066,560.

Emulsion/aggregation processes for the preparation of toners are illustrated in a number of Xerox patents, the disclosures of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256, 5,501,935, and related issued patents. The appropriate components and appropriate process aspects of these patents may be selected for the invention of the present application in embodiments thereof.

SUMMARY OF THE INVENTION

Examples of features of the present invention in embodiments thereof include:

It is a feature of the present invention to provide toner compositions and processes with many of the advantages illustrated herein.

In another feature of the present invention there are provided simple and economical processes for the preparation of black and colored toner compositions with a toner size of, for example, from about 1 to about 20 microns in volume average diameter and narrow GSD of less than about 1.40, and wherein the toners display controlled charging characteristics.

In another feature of the present invention there are provided simple processes for black and colored toner compositions, which processes involve first aggregating and coalescing latex and colorant, such as pigment particles into toner particles, followed by optional washing, and wherein the latex selected contains a dimeric, or an oligomeric acrylic acid.

In a further feature of the present invention there is provided a process for the preparation of toner compositions with an average particle volume diameter of from between about 1 to about 15 microns, and preferably from about 2 to about 7 microns, and a narrow GSD of less than about 1.35, and preferably less than about 1.25 as measured by a Coulter Counter, and which toners display suitable stable charging characteristics for proper image development.

A further feature of the present invention is the provision of toner processes whereby toner compositions with desirable triboelectric charging properties are obtainable by the aggregation and the coalescence of latex and colorant, especially pigment particles in the presence of suitable ionic and nonionic surfactants (aggregation/coalescence process), and wherein in embodiments there may be selected the cleavable surfactants of U.S. Pat. No. 5,766,818, and U.S. Ser. No. 08/960,754, the disclosures of which are totally incorporated herein by reference.

In a further feature of the present invention there is provided an aggregation/coalescence process for the preparation of toner compositions with certain effective particle sizes achieved by properly controlling the temperature of the aggregation, and which processes comprise heating a mixture of latex and colorant particles in the presence of suitable surfactants at a temperature below the glass transition temperature (Tg) of the latex resin to form toner sized aggregates, followed by heating above the resin Tg to form mechanically stable toner particles.

In a further feature of the present invention there is provided an aggregation/coalescence process for the preparation of toners with narrow particle size distribution as characterized by a GSD of less than 1.35, and preferably less than about 1.25, such as from about 1.15 to about 1.20 as measured by the Coulter Counter.

In still a further feature of the present invention there is provided an aggregation/coalescence process for toner compositions of a small particle size of from about 2 to about 7 microns in volume average diameter and GSD of less than about 1.25 in overall process yields of from about 85 percent to over 95 percent without conventional size classification.

In yet another feature of the present invention there are provided toner compositions with high stable charge levels of, for example, over 20 $\mu$C/gram, and more specifically, from about 20 $\mu$C/gram to about 40 $\mu$C/gram negative charge polarity against a suitable carrier.

Moreover, in another feature of the present invention there are provided toner compositions with excellent color mixing properties and high image projection efficiencies of in excess of about 70 percent as measured by the Match Scan II spectrophotometer available from Milton-Roy.

A further feature of the present invention is the provision of small toner compositions which when fused on paper substrates do not lead to feature ionable paper curl and image feel.

The present invention relates to toner compositions comprised of a binder, such as a binder resin, and colorant, especially pigment particles, and wherein the toner is generated with certain latexes. More specifically, the process of the present invention is comprised of aggregating a latex and colorant particles in the presence of suitable surfactants to form toner sized aggregates at, for example, a temperature below about the Tg of the latex resin, followed by coalescence of the components of the aggregates at a temperature of, for example, above about the Tg of the resin to form mechanically robust toner particles, and wherein the aggregate size, and thus the toner size, is primarily controlled by the temperature at which the aggregation is conducted, and wherein the latex contains a dimeric component, an oligomer component, or mixtures thereof. During the coalescence, a stabilization agent which prevents the aggregates from growing in size, or which minimizes growth, with increasing temperature is optionally, but preferably, added before the temperature is increased above the Tg of the latex resin. After coalescence, the mixture is cooled to, for example, about room temperature, about 25° C. to about 30° C., and the toner is isolated, and washed.

In aspects thereof the present invention is directed to a process for the preparation of toner comprising blending an aqueous colorant dispersion and a latex resin emulsion, and which latex resin is preferably generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating the resulting aggregates at a temperature about equal to, or above about the Tg of the latex resin to effect coalescence and fusing of the aggregates; and optionally isolating the toner product, washing, and drying; a process wherein the blending of the aqueous colorant dispersion with the latex resin emulsion is from about 20° C. to about 30° C.; and subsequent to coalescence the toner is isolated, followed by washing and drying, and wherein the washing removes soluble surfactants; a process wherein the dimeric acrylic acid is β-acryloxypropionic acid; a process wherein the $M_w$ of the oligomer acrylic acid is from about 200 to about 3,500, and the $M_n$ is from about 200 to about 1,500; a process wherein the mixture contains from about 10 to about 40 weight percent of the dimeric acrylic acid, and from about 60 to about 90 weight percent of the oligomer acrylic acid, and wherein the total of the two components is about 100 percent; a process wherein the mixture contains from about 20 to about 30 weight percent of the dimeric acrylic acid, and from about 70 to about 80 weight percent of the oligomer acrylic acid, and wherein the total of the components is about 100 percent; a process wherein the dimeric acrylic acid is β-acryloxypropionic acid; a process wherein the oligomeric acrylic acid is of the formula

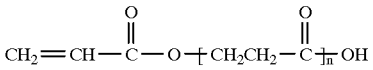

wherein n is a number of, for example, from about 2 to about 20; a process wherein the monomer is a styrene containing monomer; a process wherein the monomer is comprised of a styrene and an acrylate; a process wherein the monomer is comprised of styrene and butyl methacrylate; a process wherein there results subsequent to polymerization of the mixture of monomer and dimeric, oligomer, or mixtures thereof a polymer, or resin; a process wherein the polymer or resin is comprised of about 50 to about 85 weight percent of styrene, about 15 to about 35 weight percent of an acrylate, and about 0.5 to about 15 weight percent of an acrylic acid dimer and an acrylic acid oligomer, and wherein the total thereof is about 100 percent; a process wherein the polymer is poly(styrene-butyl acrylate-alkenoic acid), poly (styrene-butadiene-alkenoic acid), poly(methyl acrylate-butadiene-alkenoic acid), poly(styrene-isoprene-alkenoic acid), or poly(styrene-butyl acrylate-acrylonitrile-alkenoic acid), and wherein the alkenoic acids are optionally alpha, beta-ethylenically unsaturated carboxylic acids selected from dimeric acrylic acid (β-acryloxypropionic acid), oligomeric acrylic acid, or mixtures thereof with acrylic acid; a process comprising (i) preparing, or providing a aqueous colorant dispersion, which dispersion is comprised of a colorant and an ionic surfactant;

(ii) blending the colorant dispersion with a latex emulsion comprised of resin particles, a nonionic surfactant, and an ionic surfactant of opposite charge polarity to that of the ionic surfactant in the colorant dispersion;

(iii) heating the resulting mixture below about the glass transition temperature (Tg) of the latex resin particles to form toner sized aggregates;

(iv) heating the resulting aggregate suspension of (iii) above about the Tg of the latex resin particles in the presence of an aggregate is stabilizer; and (v) cooling, followed by isolating the toner product, optionally washing, and optionally drying; a process wherein the toner is prepared by blending the colorant dispersion with the latex emulsion by a high shearing device, and wherein the colorant contains an ionic surfactant, the latex contains a nonionic surfactant and an ionic surfactant of opposite charge polarity to that of ionic surfactant in the colorant dispersion; heating the resulting mixture at a temperature of about 30° C. to about 60° C. to effect formation of aggregates having a particle size of from about 2 to about 20 microns in volume average diameter; heating the aggregate suspension in the presence of an aggregate stabilizer to prevent, or minimize the aggregates from growing in size, and which heating is at a temperature of from about 65° C. to about 100° C.; and isolating the toner product, washing, and drying; a process wherein the surfactant in the colorant dispersion is a cationic surfactant, and the ionic surfactant present in the latex emulsion is an anionic surfactant, or wherein the surfactant in the colorant dispersion is an anionic surfactant, and the ionic surfactant present in the latex emulsion is a cationic surfactant; a process wherein the ionic surfactant in the colorant dispersion is a cationic surfactant, and the ionic surfactant present in the latex emulsion is an anionic surfactant; a process wherein the heating of the latex, colorant, and surfactants in the aggregation is accomplished at temperatures of from about 15° C. to about 1° C. below the Tg of the latex resin for a duration of from about 0.5 hour to about 5 hours, and the heating of the aggregate suspension in the coalescence is conducted at about 20° C. to about 50° C. above the Tg of the latex resin for a duration of about 1 hour to about 5 hours; a process wherein the product toner size is from about 1 to about 12 microns in volume average diameter, and the toner possesses a particle size distribution of from about 1.12 to about 1.35; a process wherein the nonionic surfactant present in the latex emulsion is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and wherein the anionic surfactant is selected from the group consisting of sodium dodecyl sulfate, sodium dodecylbenzene sulfate and sodium dodecyinaphthalene sulfate, wherein the anionic surfactant is selected from the group consisting of sodium dodecyl sulfate, sodium dodecylbenzene sulfate and sodium dodecyinaphthalene sulfate; and wherein the cationic surfactant is a quaternary ammonium salt; a process wherein the nonionic, and ionic surfactants are each present in an amount of from about 0.01 to about 5 weight percent of the total reaction mixture; a process wherein the latex resin is prepared by emulsion polymerization of the acrylic acid dimer, oligomer, or mixtures thereof, with vinyl monomers selected from the group consisting of styrene and substituted styrenes, 1,3-dienes, substituted 1,3-dienes, acrylates, methacrylates, acrylonitrile, acrylic acid, and methacrylic acid; a process wherein the latex resin resulting after polymerization is selected from the group consisting of poly(styrene-butadiene-alkenoic acid), poly(methylstyrene-butadiene-alkenoic acid), poly(methyl methacrylate-alkenoic acid), poly (ethyl methacrylate-butadiene-alkenoic acid), poly (propyl methacrylate-butadiene- alkenoic acid), poly (butyl methacrylate-butadiene-alkenoic acid), poly (methyl acrylate-butadiene-alkenoic acid), poly(ethyl acrylate-alkenoic acid), poly(propyl acrylate-butadiene-alkenoic acid), poly(styrene-isoprene-alkenoic acid), poly(methylstyrene-isoprene-alkenoic acid), poly(methyl methacrylate-isoprene-alkenoic acid), poly(ethyl methacrylate-isoprene-alkenoic acid), poly(propyl methacrylate-isoprene-alkenoic acid), poly (butyl methacrylate-isoprene-alkenoic acid), poly (methyl acrylate-isoprene-alkenoic acid), poly(ethyl acrylate-isoprene-alkenoic acid), poly(propyl acrylate-isoprene-alkenoic acid), poly(styrene-propyl acrylate-alkenoic acid), poly(styrene-butyl acrylate-alkenoic acid), and poly(styrene-butyl acrylate-acrylonitrile-alkenoic acid); and wherein the alkenoic acids are alpha, beta-ethylenically unsaturated carboxylic acids selected from dimeric acrylic acid (β-acryloxypropionic acid), oligomeric acrylic acid, or mixtures thereof with acrylic acid; a process wherein the resin size is from about 0.05 to about 1 micron in average volume diameter, and the colorant particle size is from about 0.01 to about 1 micron in volume average diameter; a process wherein the colorant is a pigment of carbon black, magnetite, cyan, yellow, magenta pigments, or mixtures thereof; a process wherein there is added to the surface of the formed toner metal salts, metal salts of fatty acids, silicas, metal oxides, or mixtures thereof in an amount of from about 0.1 to about 10 weight percent; a developer comprised of the toner and carrier; a process wherein the dimeric acrylic acid, or the oligomer acrylic acid is of the formula

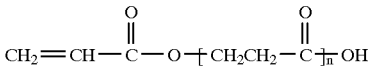

wherein n is a number of from about 1 to about 20, and wherein n is 1 for the dimeric acrylic acid, and wherein for the oligomer acrylic acid n is from about 2 to about 20; a process for the preparation of toner comprising mixing a colorant and a latex polymer emulsion, and which latex polymer is generated from a monomer dimeric acrylic acid, an oligomer acrylic acid, or mixtures thereof; heating the resulting mixture at a temperature about equal, or below about the glass transition temperature (Tg) of the latex polymer, and heating at a temperature about equal to, or above about the Tg of the latex resin; a process wherein the oligomer is acrylic acid; a process wherein the latex polymer is generated from the dimeric acrylic acid; a process wherein the latex polymer is generated from a mixture of the oligomer and the dimeric acrylic acid; aggregation/coalescence toner processes, which comprises (i) blending an aqueous colorant, such as a pigment or dye dispersion containing a cationic surfactant such as benzalkonium chloride with a latex emulsion containing an oligomer of acrylic acid, a dimer of acrylic acid, or mixtures thereof, and an anionic surfactant such as sodium dodecylbenzene sulfonate, and which blending can also be accomplished with a homogenizer, thereby causing flocculation of the latex and colorant like pigment particles primarily as a result of the destabilization caused by neutralization of oppositely charged surfactants; (ii) heating the resulting flocculent mixture at a temperature of about 30° C. to about 60° C., thereby inducing formation of toner sized aggregates, and which aggregates are comprised of latex particles, colorant particles and surfactants, and wherein the aggregate size is, for example, from about 2 microns to about 12 microns in volume average diameter with a GSD of less than about 1.35, and more specifically, from about 1.14 to about 1.25; (iii) effecting by heating coalescence of the components of the aggregates to form mechanically stable integral toner particles, and which heating is preferably accomplished at a temperature of from about 65° C. to about 100° C. for a duration of, for example, about 30 minutes to about 10 hours in the presence of additional anionic surfactant; (iv) cooling, and isolating the toner by known methods, such as filtration, washing primarily to remove surfactants that may be present, and drying; a process for the preparation of toner comprising blending an aqueous colorant dispersion and a latex emulsion containing resin formed from an oligomer acrylic acid, a dimer acrylic acid, or mixtures thereof, and a styrene monomer, such as styrene acrylate; heating the resulting mixture at a temperature below about the glass transition temperature (Tg) of the latex resin to form toner sized aggregates; heating the resulting aggregates at a temperature above about the Tg of the latex resin to effect fusion and coalescence of the components of aggregates; cooling; and isolating the toner product by filtration, washing, and drying; a process wherein the blending of the aqueous colorant dispersion with the latex emulsion containing resin is from about 20° C. to about 30° C., the pH of the mixture is from about 8 to about 11, and the toner is isolated, followed by filtration, washing and drying, and wherein the filtering removes soluble surfactants; a process for the preparation of toner comprised of resin and colorant comprising (i) preparing, or providing an aqueous colorant dispersion, which dispersion is comprised of a colorant and an ionic surfactant;

(ii) blending the colorant dispersion with a latex emulsion comprised of resin or polymer particles, formed from a monomer and an oligomer of acrylic acid, a dimer, or mixtures thereof, a nonionic surfactant, and an ionic surfactant of opposite charge polarity to that of the ionic surfactant in the colorant dispersion;

(iii) heating the resulting mixture below about the glass transition temperature (Tg) of the latex resin particles to form toner sized aggregates;

(iv) heating the resulting aggregate suspension of (iii) above about the Tg of the latex resin particles in the presence of an aggregate stabilizer;

(v) filtering and optional washing the toner product, and (vii) cooling, if appropriate, followed by isolating the toner product, optionally washing, and optionally drying; a process wherein the toner is prepared by blending a colorant dispersion with a latex emulsion by a high shearing device, and wherein the colorant dispersion is a pigment dispersion and contains an ionic surfactant, the latex contains a nonionic surfactant and an ionic surfactant of opposite charge polarity to that of the ionic surfactant in the pigment dispersion; heating the resulting mixture at a temperature of about 30° C. to about 60° C. to effect formation of aggregates having a particle size of from about 2 to about 10 microns in volume average diameter; heating the aggregate suspension in the presence of an aggregate stabilizer to prevent, or minimize the aggregates from growing in size, and which heating is at a temperature of from about 65° C. to about 100° C.; and isolating the toner product by filtration, washing, and drying; a process wherein the product toner size is from about 2 to about 10 microns in volume average diameter, and the toner possesses a particle size distribution of from about 1.12 to about 1.35; a process wherein the surfactant in the colorant dispersion is a cationic surfactant, and the ionic surfactant present in the latex emulsion is an anionic surfactant, or wherein the surfactant in the colorant dispersion is an anionic surfactant, and the ionic surfactant present in the latex emulsion is a cationic surfactant; a process wherein the ionic surfactant in the colorant water dispersion is a cationic surfactant, and the ionic surfactant present in the latex water emulsion is an anionic surfactant; a process wherein the heating of the latex, colorant, and surfactants in the aggregation (iii) is accomplished at temperatures of from about 15° C. to about 1° C. below the Tg of the latex resin for a duration of from about 0.5 hour to about 5 hours; the heating of the aggregate suspension in the coalescence (iv) is conducted at about 20° C. to about 50° C. above the Tg of the latex resin for a duration of about 1 hour to about 5 hours; a process wherein the latex resin is selected from the group consisting of alkenoic acids of poly(styrene-butadiene-alkenoic acid), poly(methylstyrene-butadiene-alkenoic acid), poly(methyl methacrylate-alkenoic acid), poly(ethyl methacrylate-butadiene-alkenoic acid), poly(propyl methacrylate-butadiene-alkenoic acid), poly(butyl methacrylate-butadiene-alkenoic acid), poly(methyl acrylate-butadiene-alkenoic acid), poly(ethyl acrylate-alkenoic acid), poly (propyl acrylate-butadiene-alkenoic acid), poly (styrene-isoprene-alkenoic acid), poly(methylstyrene-isoprene-alkenoic acid), poly(methyl methacrylate-isoprene-alkenoic acid), poly(ethyl methacrylate-isoprene-alkenoic acid), poly(propyl methacrylate-isoprene-alkenoic acid), poly(butyl methacrylate-isoprene-alkenoic acid), poly(methyl acrylate-isoprene-alkenoic acid), poly(ethyl acrylate-isoprene-alkenoic acid), poly(propyl acrylate-isoprene-alkenoic acid poly(styrene-propyl acrylate-alkenoic acid), poly (styrene-butyl acrylate-alkenoic acid), poly(styrene-butyl acrylate-acrylonitrile-alkenoic acid), and wherein the alkenoic acids are olefinically unsaturated carboxy functional monomers of alpha, beta-ethylenically unsaturated carboxylic acids, more preferably mono- and dicarboxylic acids, especially dimeric acrylic acid (β-acryloxypropionic acid), oligomeric acrylic acid, or mixtures thereof with acrylic acid, and wherein the resin is optionally present in an amount ranging from about 80 percent by weight to about 98 percent by weight of toner; a process wherein the latex resin size is from about 0.05 to about 1 micron in average volume diameter, and the colorant particle size is from about 0.01 to about 1 micron in volume average diameter; a process wherein the nonionic surfactant present in the latex emulsion containing a polymer or polymers formed by polymerization of monomer or monomers is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy) ethanol, and wherein the anionic surfactant is selected from the group consisting of sodium dodecyl sulfate, sodium dodecylbenzene sulfate, sodium tetrapropyl diphenyloxide disulfonate, and sodium dodecyinaphthalene sulfate; and wherein the cationic surfactant is optionally a quaternary ammonium salt; a process wherein the anionic surfactant is selected from the group consisting of sodium dodecyl sulfate, sodium dodecylbenzene sulfate, sodium tetrapropyl diphenyloxide disulfonate, and sodium dodecyinaphthalene sulfate; and wherein the cationic surfactant is a quaternary ammonium salt; and a process wherein the nonionic, anionic and cationic surfactants are each present in an effective amount of, for example, from about 0.01 to about 5 weight percent of the total reaction mixture; and a process wherein the colorant is a pigment of carbon black, magnetite, cyan, yellow, or mixtures thereof.

The dimer and oligomers, and more specifically, the dimers, oligomers, or mixtures thereof, like a mixture of acrylic acid, dimer and oligomers of 2-carboxyethyl acrylate are available from, for example, Polysciences, Inc, and Sipomer β-CEA™ is available from Rhone-Poulenc, and wherein preferably there is present therein a mixture of dimer, oligomer, and acrylic acid, and wherein the dimer is, for example, (amounts throughout represent examples of amounts and other suitable amounts be selected) present in an amount of from about 5 to about 60, and preferably from about 10 to about 40 weight percent, the oligomers are present in an amount of from about 30 to about 90, and preferably from about 50 to about 80 weight percent, and the acrylic acid is present in an amount of from about 2 to about 25, and preferably from about 2 to about 15 weight percent in the mixture.

The dimers and oligomers can be considered alkenoic acids, and more specifically, olefinically unsaturated carboxy functional monomers such as alpha, beta-ethylenically unsaturated carboxylic acids, preferably of the formula

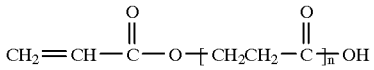

wherein n is a number of from about 1 to about 20, and preferably from about 1 to about 13, and more preferably from about 1 to about 5; and wherein the number average value of n is 1 or greater. These acids can be prepared by the Michael addition reaction of acrylic acid to itself, the degree of addition determining the value of n. The acid molecule wherein n equals 1 is diacrylic acid or β-acryloxypropionic acid of the formula

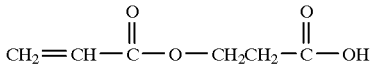

and which acid preferably possesses a molecular weight of about 144 g/mole when n is equal to 1.

The oligomer acrylic acid preferably possesses an n value of from about 2 to about 20, and preferably from about 2 to about 13, and more preferably from about 2 to about 5, and the $M_w$ thereof of the oligomer acrylic acid is, for example, from about 200 to about 3,500, preferably from about 200 to about 2,500, and the $M_n$ thereof is, for example, from about 200 to about 1,500, and preferably from about 200 to about 1,000.

The latex resin can be generated from the dimer acrylic acid, the oligomer acrylic acid, or mixtures thereof, and monomers, such as styrene, acrylates, methacrylates, butadiene, isoprene, acrylonitrile, acrylic acid, methacrylic acid, styrene acrylates, styrene methacrylates, and the like. The presence of dimeric acrylic acid or the oligomeric acrylic acid, or the mixture thereof can be in various amounts of from 0.1 to about 25 percent, and preferably of from 0.5 to about 10 percent by weight of the polymer resin.

Illustrative examples of latex resins or polymers formed from appropriate polymerization of monomers include known polymers such as polymers formed as illustrated herein, such as from alkenoic acids, which are olefinically unsaturated carboxy functional monomers include alpha, beta-ethylenically unsaturated carboxylic acids, more preferably mono- and dicarboxylic acids, especially dimeric acrylic acid (β-acryloxypropionic acid), oligomer acrylic acid, and mixtures thereof with acrylic acid, and wherein the polymers generated more specifically include poly(styrene-butadiene-alkenoic acid), poly(methylstyrene-butadiene-alkenoic acid), poly(methyl methacrylate-alkenoic acid), poly(ethyl methacrylate-butadiene-alkenoic acid), poly (propyl methacrylate-butadiene-alkenoic acid), poly(butyl methacrylate-butadiene-alkenoic acid), poly(methyl acrylate-butadiene-alkenoic acid), poly(ethyl acrylate-alkenoic acid), poly(propyl acrylate-butadiene-alkenoic acid), poly(styrene-isoprene-alkenoic acid), poly (methylstyrene-isoprene-alkenoic acid), poly(methyl methacrylate-isoprene-alkenoic acid), poly(ethyl methacrylate-isoprene-alkenoic acid), poly(propyl methacrylate-isoprene-alkenoic acid), poly(butyl methacrylate-isoprene-alkenoic acid), poly(methyl acrylate-isoprene-alkenoic acid), poly(ethyl acrylate-isoprene-alkenoic acid), poly(propyl acrylate-isoprene-alkenoic acid), poly(styrene-propyl acrylate-alkenoic acid), poly (styrene-butyl acrylate-alkenoic acid), and poly(styrene-butyl acrylate-acrylonitrile-alkenoic acid). The resin selected in embodiments is present in various effective amounts, such as for example, from about 85 weight percent to about 98 weight percent of the toner, and the latex particle size can be, for example, from about 0.05 micron to about 1 micron in volume average diameter as measured by the Brookhaven nanosize particle analyzer. Other sizes and effective amounts of latex particles may be selected in embodiments. The total of all toner components, such as resin, colorant, and optional toner additives is equal to about 100 percent, or 100 parts.

The resin, or polymer selected is preferably prepared by emulsion polymerization methods, and the monomers utilized in such processes include the dimer acrylic acid, the oligomer acrylic acid, or mixtures thereof, and styrene, acrylates, methacrylates, butadiene, isoprene, acrylonitrile, acrylic acid, methacrylic acid, styrene acrylates, styrene methacrylates, and the like. Known chain transfer agents, for example dodecanethiol, in effective amounts of, for example, from about 0.1 to about 10 percent, and/or carbon tetrabromide in effective amounts of from about 0.1 to about 10 percent, can also be employed to control the resin molecular weight during the polymerization. Other processes of obtaining resin particles of from, for example, about 0.05 micron to about 1 micron can be selected from polymer microsuspension process, such as the processes disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes. Also, the polymer can be generated by adding a monomer to the reaction mixture.

Various known colorants, such as dyes, pigments, mixtures of dyes, mixtures of pigments, mixtures of pigments and dyes, other known suitable colorants, and especially pigments present in the toner in an effective amount of, for example, from about 1 to about 20 percent by weight of the toner, and preferably in an amount of from about 3 to about 10 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue pigment or mixtures thereof. Specific examples of 20 pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D.

TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, and yellow pigments, and mixtures thereof. Examples of magentas that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a mono azo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. Dye examples include known dyes, such as food dyes, and the like.

Colorant includes pigments, dyes, mixtures thereof, mixtures of pigments, mixtures of dyes, and the like.

Surfactants in amounts of, for example, from about 0.01 to about 20, or more specifically, from about 0.1 to about 15 weight percent of the reaction mixture in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example, from about 0.01 to about 10 percent by weight, and preferably from about 0.1 to about 5 percent by weight of the reaction mixture.

Examples of ionic surfactants include anionic and cationic with examples of anionic surfactants being, for example, sodium dodecyl sulfate (SDS), sodium dodecylbenzene sulfonate, sodium tetrapropyl diphenyloxide disulfonate sodium dodecylnaphthalene sulfate, dialkyl benzenealkyl, sulfates and sulfonates, abitic acid, available from Aldrich, NEOGEN R™, NEOGEN SC™ obtained from Kao, DOWFAX 2A1™ obtained from Dow Chemical, and the like. An effective concentration of the anionic surfactant generally employed is, for example, from about 0.01 to about 10 percent by weight, and preferably from about 0.1 to about 5 percent by weight of the reaction mixture.

Typical cationic surfactants selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.01 percent to about 5 percent by weight of the reaction mixture. Preferably, the molar ratio of the cationic surfactant used for flocculation to the anionic surfactant used in the latex preparation is in the range of from about 0.5 to about 4, and preferably from about 0.5 to about 2.

Additional surfactant, which may be added to the aggregate suspension during or prior to coalescence to, for example, prevent the aggregates from growing in size, minimizing aggregate growth, and/or for stabilizing the aggregate size with increasing temperature can be selected from anionic surfactants, such as sodium dodecylbenzene sulfonate, sodium tetrapropyl diphenyloxide disulfonate, sodium dodecylnaphthalene sulfate, dialkyl benzenealkyl, sulfates and sulfonates, abitic acid, available from Aldrich, NEOGEN R™, NEOGEN SC™ obtained from Kao, DOWFAX 2A1™ obtained from Dow Chemical, and the like. These surfactants can also be selected from nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant generally employed as an aggregate size stabilization agent is, for example, from about 0.01 to about 10 percent by weight, and preferably from about 0.1 to about 5 percent by weight of the reaction mixture.

Surface additives that can be added to the toner compositions to primarily improve their powder flow properties include, for example, metal salts, metal salts of fatty acids, colloidal silicas, metal oxides, such as titanium oxides, tin oxides, strontium titanates, other known flow additives, mixtures thereof and the like, which additives are usually present in an amount of, for example, from about 0.1 to about 2 weight percent, reference for example U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa, the coated silicas of U.S. Ser. Nos. 09/132,188, 09/132,632, and 09/132,185, the disclosures of each application being totally incorporated herein by reference, each in amounts of, for example, from about 0.1 to about 3 percent, and which additives can be, for example, added during the aggregation or blended into the formed toner product. Moreover, the toner can contain known charge additives, such as DDAMS, cetyl pyridium halide, and the like in various amounts, such as for example from about 0.5 to about 5 weight percent.

Developer compositions can be prepared by mixing the toners obtained with the processes of the present invention with known carrier particles, with a carrier core of for example, steel, ferrites, and the like, reference U.S. Pat. Nos. 4,937,166 and 4,935,326, the disclosures of which are totally incorporated herein by reference, for example from about 2 percent toner concentration to about 8 percent toner concentration. The carrier cores may also include polymer coatings thereof and conductive components in the polymer coating, such as a suitable carbon black.

Imaging methods are also envisioned with the toners of the present invention, reference for example a number of the patents mentioned herein, and U.S. Pat. No. 4,265,990, the disclosure of which is totally incorporated herein by reference.

The following Examples are provided.

EXAMPLE I

A latex was prepared by the semicontinuous emulsion polymerization of styrene, butyl acrylate, and alkenoic acid as follows. The alkenoic acid is comprised of 7 parts (by weight) of acrylic acid, 22 parts of the dimer β-acryloxypropionic acid, and 71 parts of oligomeric acrylic acid of the formula

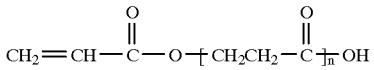

wherein n is a number of from 2 to 5, as determined on a Finnigan TSQ 7000 Electrospray Ionization Mass Spectrometer, and the $M_w$ of the oligomer acrylic acid is about 285, and the $M_n$ is about 270, both $M_w$ and $M_n$ being determined on a Waters Gel Permeation Chromatography.

A 2 liter jacketed glass flask with a stirrer set at 200 rpm, and containing 8.8 grams of DOWFAX 2A1™ (sodium tetrapropyl diphenyloxide disulfonate, 47 percent active, available from Dow Chemical), 3.0 grams of polyoxyethylene nonyl phenyl ether nonionic surfactant, ANTAROX CA 897™ Trm (70 percent active), and 519 grams of deionized water was purged with nitrogen for 30 minutes while the temperature was from about 25° C. to 80° C. A monomer emulsion was prepared by homogenizing a monomer mixture (405 grams the above generated mixture of alkenoic acids, and 7.1 grams of 1-dodecanethiol) with an aqueous solution (4.4 grams of DOWFAX 2A1 ™, 1.5 grams of ANTAROX CA-897™, and 251 grams of deionized water) at 10,000 rpm for 5 minutes at room temperature of about 25° C. via VirTishear Cyclone Homogenizer. Forty one (41) grams of seed were removed from the monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring was continued for an additional 20 minutes to allow a seed particle formation. The remaining 795 grams of monomer emulsion were fed continuously into the reactor over 4 hours and 20 minutes. The nitrogen purge was reduced to a slow trickle to maintain a small positive pressure. After the above monomer emulsion addition was completed, the reaction was allowed to post react for 90 minutes at 80° C., then cooled to 25° C. by cool water. The resulting polymer latex of the styrene-butyl acrylate-acrylic acid-β-acryloxypropionic acid-oligomeric acrylic acid polymer 75/25/0.4/1.3/4.3 parts (by weight) possessed an $M_w$ of 31,000, and an $M_n$ of 9,500, as determined on a Waters GPC, and a mid-point Tg of 53.0° C., as measured on a Seiko DSC. The latex resin possessed a volume average diameter of 192 nanometers as measured by light scattering technique on a Coulter N4 Plus Particle Sizer.

260 Grams of the above prepared latex emulsion and 220 grams of an aqueous cyan pigment dispersion containing 7.6 grams of Cyan Pigment 15:3 (53 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1 hour before 26 milliliters of 20 percent an aqueous surfactant BIOSOFT D-40™ solution were added. Aggregates with a particle size (volume average diameter) of 6.7 microns with a GSD=1.17, as measured on the Coulter Counter, were obtained. Subsequently, the mixture was heated to 93° C. and held there for a period of 2.5 hours before cooling down to room temperature, about 25° C. throughout, filtered, washed with water, and dried in a freeze dryer. The final toner product evidenced a particle size of 6.9 microns in volume average diameter with a particle size distribution of 1.19 as measured on a Coulter Counter.

The resulting toner, that is the above final toner product, was comprised of about 93 percent of the above prepared polymer poly(styrene-butyl acrylate-acrylic acid-β-acryloxypropionic acid-oligomeric acrylic acid), and Cyan Pigment 15:3, about 7 percent by weight of toner, and which toner possessed a volume average diameter of 6.9 microns and a GSD of 1.19.

Toner Fusing Evaluation

Standard fusing properties of the prepared toner compositions were evaluated throughout as follows: unfused images of toner on paper with a controlled toner mass per unit area of 0.55 milligram/cm$^2$ were produced by one of a number methods. A suitable electrophotographic developer was generated by mixing from 2 to 10 percent by weight of the toner with a suitable electrophotographic carrier, such as, for example, a 90 micron diameter ferrite core, spray coated with 0.5 weight percent of a terpolymer of poly(methyl methacrylate), styrene, and vinyltriethoxysilane, and roll milling the mixture for 10 to 30 minutes to achieve a tribocharge of between −5 to −20 microcoulombs per gram of toner as measured by the Faraday Cage. The developer was introduced into a small electrophotographic copier, such as the Xerox Corporation 5090, in which the fuser system had been disconnected. Between 20 to 50 unfused images of a test pattern of a 65 millimeter by 65 millimeter square solid area were produced on 8.5 by 11 inch sheets of a typical electrophotographic paper such as Xerox Corporation Image LX paper.

The unfused images were then fused by feeding them through a hot roll fuser consisting of a fuser roll and pressure roll with elastomer surfaces, both of which were heated to a controlled temperature. Fused images were produced over a range of hot roll fusing temperatures from about 130° C. to about 210° C. The gloss of the fused images was measured according to TAPPI Standard T480 at a 75° angle of incidence and reflection using a Novo-Gloss Statistical Gloss Meter, Model GL-NG 1002S from Paul N. Gardner Company, Inc. The degree of permanence of the fused images was evaluated by the Crease Test (crease test data can be expressed as MFT). The fused image was folded under a specific weight with the toner image to the inside of the fold. The image was then unfolded and any loose toner wiped from the resulting Crease with a cotton swab. The average width of the paper substrate, which shows through the fused toner image in the vicinity of the Crease, was measured with a custom built image analysis system.

The fusing performance of a toner is traditionally judged from the fusing temperatures required to achieve acceptable image gloss and fix. For high quality color applications, an image gloss greater than 50 gloss units is preferred. The minimum fuser temperature required to produce a gloss of 50 is defined as $T(G_{50})$ for a given toner. Similarly, the minimum fuser temperature required to produce a Crease value less than the maximum acceptable Crease is known as the Minimum Fix Temperature (MFT) for a given toner. In general, it is desirable to have both $T(G_{50})$ and MFT as low as possible, such as for example $T(G_{50})$ is below 200° C., and preferably below 190° C., and MFT is below 190° C., and preferably below 170° C. in order to minimize the power requirements of the hot roll fuser.

Fusing evaluation indicated that the toner of this Example had a $T(G_{50})$ of 190° C. and an MFT of 160° C.

Toner Triboelectric Charge Evaluation

In 120 milliliter glass bottles, 1 gram of the above prepared toner was added to 24 grams of carrier particles comprised of 90 micron diameter ferrite core, spray coated with 0.5 weight percent of a terpolymer of poly(methyl methacrylate), styrene, and vinyltriethoxysilane, coating weight of 1 percent. For each combination of toner and carrier, the above developer mixture was retained in an environmental chamber at 50 percent relative humidity overnight, about 16 hours. The bottles were then sealed, and the toner and carrier particles were mixed by roll milling for 30 minutes to obtain a stable triboelectric charge. The toner charge was measured using the standard Faraday Cage tribo blow-off apparatus.

Triboelectric charge evaluation indicated that the toner of this Example had a toner tribo of 28 $\mu$C/gram (microcoulombs per gram) at 50 percent relative humidity.

EXAMPLE II

A latex was prepared by the semicontinuous emulsion polymerization of styrene, butyl acrylate, and alkenoic acid as follows. The composition of the above used alkenoic acid was the same as Example I. A 2 liter jacketed glass flask with a stirrer set at 200 rpm, and containing 8.8 grams of DOWFAX 2A1™ (47 percent active), 3 grams of polyoxyethylene nonyl phenyl ether nonionic surfactant, ANTAROX CA 897™ (70 percent active), and 519 grams of deionized water was purged with nitrogen for 30 minutes while the temperature was from about 25° C. to about 80° C. A monomer emulsion was prepared by homogenizing a monomer mixture (405 grams of styrene, 135 grams of n-butyl acrylate, 16.2 grams of the above prepared mixture of alkenoic acids, and 7.1 grams of 1-dodecanethiol) with an aqueous solution (4.4 grams of DOWFAX 2A1™, 1.5 grams of ANTAROX CA-897™, and 251 grams of deionized water) at 10,000 rpm for 5 minutes at room temperature of about 25° C. via VirTishear Cyclone Homogenizer. Forty one (41) grams of seed was removed from the monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 779 grams of monomer emulsion were fed continuously into the reactor over 4 hours and 8 minutes. The nitrogen purge was reduced to a slow trickle to maintain a small positive pressure. After the above monomer emulsion addition was completed, the reaction was allowed to post react for 90 minutes at 80° C., then cooled to 25° C. by cool water. The resulting latex of the styrene-butyl acrylate-acrylic acid-β-acryloxypropionic acid-oligomeric acrylic acid polymer 75/25/0.2/0.7/2.2 parts (by weight) possessed an $M_w$ of 30,000, and an $M_n$ of 8,900, as determined on a Waters GPC, and a mid-point Tg of 51.3° C., as measured on a Seiko DSC. The latex resin possessed an volume average diameter of 218 nanometers as measured by light scattering technique on a Coulter N4 Plus Particle Sizer.

260 Grams of the above prepared latex emulsion and 220 grams of an aqueous cyan pigment dispersion containing 7.6 grams of Cyan Pigment 15:3 (53 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1.5 hours before 26 milliliters of 20 percent aqueous BIOSOFT D-40™ solution were added. Aggregates with a particle size (volume average diameter) of 6.6 microns with a GSD=1.17, as measured on the Coulter Counter, were obtained. Subsequently, the mixture was heated to 93° C. and held there for a period of 2.5 hours before cooling down to room temperature, about 250C. throughout, filtered, washed with water, and dried in a freeze dryer. The final toner product evidenced a particle size of 7.1 microns in volume average diameter with a particle size distribution of 1.20 as measured on a Coulter Counter.

The resulting toner, that is the above final toner product, was comprised of about 93 percent of the above generated polymer, poly(styrene-butyl acrylate-acrylic acid-β-acryloxypropionic acid-oligomeric acrylic acid), and Cyan Pigment 15:3, about 7 percent by weight of toner, with a toner volume average diameter of 7.1 microns and a GSD of 1.20.

Fusing evaluation indicated that the toner of this Example had a $T(G_{50})$ of 196° C. and an MFT of 166° C. Triboelectric charge evaluation showed that the toner of this Example had a toner tribo of 23 μC/gram (microcoulombs per gram) at 50 percent relative humidity.

EXAMPLE III

A latex was prepared by the semicontinuous emulsion polymerization of styrene, butyl acrylate, and alkenoic acid as follows. The composition of the above used alkenoic acid was the same as Example I. A 2 liter jacketed glass flask with a stirrer set at 200 rpm, and containing 8.8 grams of DOWFAX 2A1™ (sodium tetrapropyl diphenyloxide disulfonate, 47 percent active, available from Dow Chemical), 3 grams of polyoxyethylene nonyl phenyl ether nonionic surfactant, ANTAROX CA 897™ (70 percent active), and 519 grams of deionized water was purged with nitrogen for 30 minutes while the temperature was from about 25° C. to 80° C.. A monomer emulsion was prepared by homogenizing a monomer mixture (405 grams of styrene, 135 grams of n-butyl acrylate, 48.6 grams of above prepared mixture of alkenoic acids and 7.1 grams of 1-dodecanethiol) with an aqueous solution (4.4 grams of DOWFAX 2A1™, 1.5 grams of ANTAROX CA-897™, and 251 grams of deionized water) at 10,000 rpm for 5 minutes at room temperature of about 25° C. via VirTishear Cyclone Homogenizer. Forty one (41) grams of seed were removed from the monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 812 grams of monomer emulsion were fed continuously into the reactor over 4 hours and 27 minutes. The nitrogen purge was reduced to a slow trickle to maintain a small positive pressure. After the above monomer emulsion addition was completed, the reaction was allowed to post react for 90 minutes at 80° C., then cooled to 25° C. by cool water. The resulting latex of the styrene-butyl acrylate-acrylic acid-β-acryloxypropionic acid-oligomeric acrylic acid polymer 75/25/0.6/2/6.4 parts (by weight) possessed an $M_w$ of 32,000, and a $M_n$ of 8,800, as determined on a Waters GPC, and a mid-point Tg of 54.5° C., as measured on a Seiko DSC. The latex resin possessed an volume average diameter of 179 nanometers as measured by light scattering technique on a Coulter N4 Plus Particle Sizer.

260 Grams of the above prepared latex emulsion and 220 grams of an aqueous cyan pigment dispersion containing 7.6 grams of Cyan Pigment 15:3 (53 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 480C. for 1.5 hours before 26 milliliters of 20 percent aqueous BIOSOFT D-40™ solution were added. Aggregates with a particle size (volume average diameter) of 6.7 microns with a GSD=1.17, as measured on the Coulter Counter, were obtained. Subsequently, the mixture was heated to 93° C. and held there for a period of 3 hours before cooling down to room temperature, about 25° C. throughout, filtered, washed with water, and dried in a freeze dryer. The final toner product evidenced a particle size of 7.1 microns in volume average diameter with a particle size distribution of 1.18 as measured on a Coulter Counter.

The resulting toner, that is the above final toner product, was comprised of about 93 percent of the above generated polymer poly(styrene-butyl acrylate-acrylic acid-β-acryloxypropionic acid-oligomeric acrylic acid), and Cyan Pigment 15:3, about 7 percent by weight of toner, with a toner volume average diameter of 7.1 microns and a GSD of 1.18.

Fusing evaluation evidenced that the toner of this Example had a T(G50) of 197° C. and an MFT of 160° C. Triboelectric charge evaluation showed that the toner of this Example had a toner tribo of 32 μC/gram (microcoulombs per gram) at 50 percent relative humidity.

EXAMPLE IV

A latex was prepared by the semicontinuous emulsion polymerization of styrene, butyl acrylate, and β-acryloxypropionic acid as follows. β-Acryloxypropionic acid, which is a dimeric acrylic acid, was prepared by dimerization of acrylic acid by the Michael addition reaction prompted by triphenylphosphine. β-Acryloxypropionic acid of the formula $CH_2{=}CHCO_2CH_2CH_2CO_2H$, as determined on a Finnigan TSQ 7000 Electrospray Ionization Mass Spectrometer, and the $M_w$ of the β-acryloxypropionic acid is about 144, as determined on a Waters Gel Permeation Chromatography. A 2 liter jacketed glass flask with a stirrer set at 200 rpm, and containing 8.8 grams of DOWFAX 2A1™ (47 percent active), 3 grams of polyoxyethylene nonyl phenyl ether nonionic surfactant, ANTAROX CA 897™ (70 percent active), and 519 grams of deionized water were purged with nitrogen for 30 minutes while the temperature was from about 25° C. to 80° C. A monomer emulsion was prepared by homogenizing a monomer mixture (405 grams of styrene, 135 grams of n-butyl acrylate, 32.4 grams of β-acryloxypropionic acid, and 7.1 grams of 1-dodecanethiol) with an aqueous solution (4.4 grams of DOWFAX 2A1™, 1.5 grams of ANTAROX CA-897™, and 251 grams of deionized water) at 10,000 rpm for 5 minutes at room temperature of about 25° C. via VirTishear Cyclone Homogenizer. Forty one (41) grams of seed was removed from the monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 795 grams of monomer emulsion were fed continuously into the reactor over 4 hours and 16 minutes. The nitrogen purge was reduced to a slow trickle to maintain a small positive pressure. After the above monomer emulsion addition was completed, the reaction was allowed to post react for 90 minutes at 80° C., then cooled to 25° C. by cool water. The resulting latex polymer of the styrene-butyl acrylate-β-acryloxypropionic acid polymer 75/25/6 parts (by weight) possessed an $M_w$ of 32,000, and an $M_n$ of 9,800, as determined on a Waters GPC, and a mid-point Tg of 52.1° C., as measured on a Seiko DSC. The latex resin possessed an volume average diameter of 190 nanometers as measured by light scattering technique on a Coulter N4 Plus Particle Sizer.

260 Grams of the above prepared latex emulsion and 220 grams of an aqueous cyan pigment dispersion containing 7.6 grams of Cyan Pigment 15:3 (53 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 49° C. for 1.5 hours before 26 milliliters of 20 percent aqueous BIOSOFT D-40™ solution were added. Aggregates with a particle size (volume average diameter) of 6.9 microns with a GSD=1.18, as measured on the Coulter Counter, were obtained. Subsequently, the mixture was heated to 93° C. and held there for a period of 3 hours before cooling down to room temperature, about 25° C. throughout, filtered, washed with water, and dried in a freeze dryer. The final toner product evidenced a particle size of 7.3 microns in volume average diameter with a particle size distribution of 1.19 as measured on a Coulter Counter.

The resulting toner, that is the above final toner product, was comprised of about 93 percent of the above prepared polymer of poly(styrene-butyl acrylate-β-acryloxypropionic acid), and Cyan Pigment 15:3, about 7 percent by weight of toner, with a toner volume average diameter of 7.3 microns and a GSD of 1.19.

Fusing evaluation indicated that the toner of this Example had a $T(G_{50})$ of 196° C. and an MFT of 164° C. Triboelectric charge evaluation showed that the toner of this Example had a toner tribo of 26 μC/gram (microcoulombs per gram) at 50 percent relative humidity.

EXAMPLE V

A latex was prepared by the semicontinuous emulsion polymerization of styrene, butyl acrylate, and alkenoic acid (a mixture of acrylic acid, dimer, and oligomers) as follows. The alkenoic acid is comprised of 2 parts (by weight) acrylic acid, 12 parts of dimeric β-acryloxypropionic acid, and 86 parts of oligomeric acrylic acid of the formula

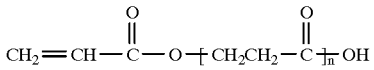

wherein n is a number of from 2 to 7 as determined on a Finnigan TSQ 7000 Electrospray Ionization Mass Spectrometer, and the $M_w$ of the oligomeric acrylic acid is about 479, and the $M_n$ is about 381, as determined on a Waters Gel Permeation Chromatography.

A 2 liter jacketed glass flask with a stirrer set at 200 rpm, and containing 8.8 grams of DOWFAX 2A1™ (47 percent active), 3 grams of polyoxyethylene nonyl phenyl ether nonionic surfactant, ANTAROX CA 897™ (70 percent active), and 519 grams of deionized water was purged with nitrogen for 30 minutes at a temperature of from about 25° C. to about 80° C. A monomer emulsion was prepared by homogenizing a monomer mixture (405 grams of styrene, 135 grams of n-butyl acrylate, 16.2 grams of the mixture of dimeric/oligomeric acrylic acids, and 7.1 grams of 1-dodecanethiol) with an aqueous solution (4.4 grams of DOWFAX 2A1™, 1.5 grams of ANTAROX CA-897™, and 251 grams of deionized water) at 10,000 rpm for 5 minutes at room temperature of about 25° C. via VirTishear Cyclone Homogenizer. Forty one (41) grams of seed was removed from the monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 795 grams of monomer emulsion were fed continuously into the reactor over 4 hours and 23 minutes. The nitrogen purge was reduced to a slow trickle to maintain a small positive pressure. After the above monomer emulsion addition was completed, the reaction was allowed to post react for 90 minutes at 80° C., then cooled to 25° C. by cool water. The resulting latex contained the styrene-butyl acrylate-acrylic acid-β-acryloxypropionic acid-oligomeric acrylic acid polymer 75/25/0.1/0.7/5.2 parts (by weight) possessed an $M_w$ of 32,000, an $M_n$ of 9,400, as determined on a Waters GPC, and a mid-point Tg of 51.0C., as measured on a Seiko DSC. The latex resin possessed an volume average diameter of 191 nanometers as measured by light scattering technique on a Coulter N4 Plus Particle Sizer.

260 Grams of the above prepared latex emulsion and 220 grams of an aqueous cyan pigment dispersion containing 7.6 grams of Cyan Pigment 15:3 (53 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1.5 hours before 26 milliliters of 20 percent aqueous BIOSOFT D-40™ solution were added. Aggregates with a particle size (volume average diameter) of 6.7 microns with a GSD=1.19, as measured on the Coulter Counter, were obtained. Subsequently, the mixture was heated to 93° C. and held there for a period of 2.5 hours before cooling down to room temperature, about 25° C. throughout, filtered, washed with water, and dried in a freeze dryer. The final toner product evidenced a particle size of 7.2 microns in volume average diameter with a particle size distribution of 1.22 as measured on a Coulter Counter.

The resulting toner, that is the above final toner product, was comprised of about 93 percent of the above prepared polymer poly(styrene-butyl acrylate-acrylic acid-β-acryloxypropionic acid-oligomeric acrylic acid), and Cyan Pigment 15:3, about 7 percent by weight of toner, with a toner volume average diameter of 7.1 microns and a GSD of 1.20.

Fusing evaluation indicated that the toner of this Example had a $T(G_{50})$ of 197° C. and an MFT of 161° C. Triboelectric charge evaluation showed that the toner of this Example had a toner tribo of 30 μC/gram (microcoulombs per gram) at 50 percent relative humidity.

COMPARATIVE EXAMPLE A

A latex was prepared by the semicontinuous emulsion polymerization of styrene, butyl acrylate, and acrylic acid, as follows. A 2 liter jacketed glass flask with a stirrer set at 200 rpm, and containing 8.8 grams of DOWFAX 2A1™ (47 percent active), 3 grams of polyoxyethylene nonyl phenyl ether nonionic surfactant, ANTAROX CA 897™ (70 percent active), and 519 grams of deionized water was purged with nitrogen for 30 minutes while the temperature was from about 25° C. to about 80° C. A monomer emulsion was prepared by homogenizing a monomer mixture (405 grams of styrene, 135 grams of n-butyl acrylate, 16.2 grams of acrylic acid, and 7.1 grams of 1-dodecanethiol) with an aqueous solution (4.4 grams of DOWFAX 2A1™, 1.5 grams of ANTAROX CA-897™, and 251 grams of deionized water) at 10,000 rpm for 5 minutes at room temperature of about 25° C. via VirTishear Cyclone Homogenizer. Forty one (41) grams of seed were removed from the monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring continued for an additional 20 minutes to allow a seed particle formation. The remaining 779 grams of monomer emulsion were fed continuously into the reactor over 4 hours and 27 minutes. The nitrogen purge was reduced to a slow trickle to maintain a small positive pressure. After the above monomer emulsion addition was completed, the reaction was allowed to post react for 90 minutes at 80° C., then cooled to 25° C. by cool water. The resulting latex with the styrene-butyl acrylate-acrylic acid-β-acryloxypropionic acid-oligomeric acrylic acid polymer 75/25/3 parts (by weight) possessed an $M_w$ of 28,000, an $M_n$ of 9,100, as determined on a Waters GPC, and a mid-point Tg of 52.8° C., as measured on a Seiko DSC. The latex resin possessed an volume average diameter of 183 nanometers as measured by light scattering technique on a Coulter N4 Plus Particle Sizer.

260 Grams of the above prepared latex emulsion and 220 grams of an aqueous cyan pigment dispersion containing 7.6 grams of Cyan Pigment 15:3 (53 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1.5 hours before 26 milliliters of 20 percent aqueous BIOSOFT D-40™ solution were added. Aggregates with a particle size (volume average diameter) of 6.5 microns with a GSD=1.18, as measured on the Coulter Counter, were obtained. Subsequently, the mixture was heated to 93° C. and held there for a period of 2.5 hours before cooling down to room temperature, about 25° C. throughout, filtered, washed with water, and dried in a freeze dryer. The final toner product evidenced a particle size of 6.9 microns in volume average diameter with a particle size distribution of 1.19 as measured on a Coulter Counter.

The resulting toner, that is the above final toner product, was comprised of about 93 percent of the above prepared polymer, poly(styrene-butyl acrylate-acrylic acid), and Cyan Pigment 15:3, about 7 percent by weight of toner, with a volume average diameter of 6.91 microns and a GSD of 1.19.

Fusing evaluation indicated that the toner of this Comparative Example had a $T(G_{50})$ of 200° C. and an MFT of 182° C., or significantly higher fusing temperatures than those of the toners of Example I to Example V. Triboelectric charge evaluation showed that the toner of this Comparative Example had a lower toner tribo of 13 μC/gram (microcoulombs per gram) at 50 percent relative humidity, a significantly lower charging level than those of the toners of Example I to Example V.

EXAMPLE VI

260 Grams of the above prepared latex emulsion of Example I and 220 grams of an aqueous magenta pigment dispersion containing 24 grams of Magenta Pigment 81.3 (21 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1 hour before 26 milliliters of 20 percent aqueous BIOSOFT D-40™ solution were added. Aggregates with a particle size (volume average diameter) of 6.6 microns with a GSD=1.17, as measured on the Coulter Counter, were obtained. Subsequently, the mixture was heated to 93° C. and held there for a period of 4 hours before cooling down to room temperature, about 25° C. throughout, filtered, washed with water, and dried in a freeze dryer. The final toner product evidenced a particle size of 7.1 microns in volume average diameter with a particle size distribution of 1.18 as measured on a Coulter Counter.

The resulting toner, that is the above final toner product, was comprised of about 95 percent of polymer, poly (styrene-butyl acrylate-acrylic acid-β-acryloxypropionic acid-oligomeric acrylic acid), and Magenta Pigment 81.3, about 5 percent by weight of toner, with a volume average diameter of 7.1 microns and a GSD of 1.18.

Fusing evaluation showed that the toner of this Example had a T(G=) of 194° C. and an MFT of 160° C. Triboelectric charge evaluation showed that the toner of this Example had a toner tribo of 28 μC/gram (microcoulombs per gram) at 50 percent relative humidity.

EXAMPLE VII

260 Grams of the above prepared latex emulsion of Example I and 220 grams of an aqueous yellow pigment dispersion containing 45 grams of Yellow Pigment Y-17 (21 percent solids), and 2.6 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1.5 hours before 26 milliliters of 20 percent aqueous BIOSOFT D-40 solution were added. Aggregates with a particle size (volume average diameter) of 6.3 microns with a GSD =1.20, as measured on the Coulter Counter, were obtained. Subsequently, the mixture was heated to 93° C. and held there for a period of 4 hours before cooling down to room temperature, about 25° C. throughout, filtered, washed with water, and dried in a freeze dryer. The final toner product evidenced a particle size of 7 microns in volume average diameter with a particle size distribution of 1.23 as measured on a Coulter Counter.

The resulting toner, that is the above final toner product, was comprised of about 90 percent of the polymer poly (styrene-butyl acrylate- acrylic acid-β-acryloxypropionic acid-oligomeric acrylic acid), and Yellow Pigment Y-17, about 10 percent by weight of toner, with an volume average diameter of 7 microns and a GSD of 1.23.

Fusing evaluation evidenced that the toner of this Example had a $T(G_{50})$ of 194° C. and an MFT of 155° C. Triboelectric charge evaluation showed that the toner of this Example had a toner tribo of 35 μC/gram (microcoulombs per gram) at 50 percent relative humidity.

EXAMPLE VIII

260 Grams of the above prepared latex emulsion of Example I and 220 grams of an aqueous black pigment dispersion containing 7.6 grams of Black Pigment REGAL 330® carbon black (21 percent solids), and 2.6 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1.5 hours before 26 milliliters of 20 percent aqueous BIOSOFT D-40™ solution were added. Aggregates with a particle size (volume average diameter) of 6.2 microns with a GSD=1.19, as measured on the Coulter Counter, were obtained. Subsequently, the mixture was heated to 93° C. and held there for a period of 3 hours before cooling down to room temperature, about 25° C. throughout, filtered, washed with water, and dried in a freeze dryer. The final toner product evidenced a particle size of 6.7 microns in volume average diameter with a particle size distribution of 1.21 as measured on a Coulter Counter.

The resulting toner, that is the above final toner product, was comprised of about 95 percent of the polymer poly (styrene-butyl acrylate-acrylic acid-β-acryloxypropionic acid-oligomeric acrylic acid), and Black Pigment REGAL 330® carbon black, about 5 percent by weight of toner, with an volume average diameter of 6.7 microns and a GSD of 1.21.

Fusing evaluation indicated that the toner of this Example had a $T(G_{50})$ of 193° C. and an MFT of 161° C. Triboelectric charge evaluation showed that the toner of this Example had a toner tribo of 23 μC/gram (microcoulombs per gram) at 50 percent relative humidity.

Other modifications of the present invention may occur to those of ordinary skill in the art subsequent to a review of the present application and these modifications, including equivalents thereof, are intended to be included within the scope of the present invention.

What is claimed is:

1. A process for the preparation of toner comprising blending an aqueous colorant dispersion and a latex resin emulsion, and which latex resin is generated from a dimeric acrylic acid, an oligomer acrylic acid, or mixtures thereof and a monomer; heating the resulting mixture at a temperature about equal, or below about the glass transition temperature (Tg) of the latex resin to form aggregates; heating said resulting aggregates at a temperature about equal to, or above about the Tg of the latex resin to effect coalescence and fusing of the aggregates; and optionally isolating the toner product, washing, and drying.

2. A process in accordance with claim 1 wherein said blending of said aqueous colorant dispersion with said latex resin emulsion is from about 20° C. to about 30° C.; and subsequent to coalescence said toner is isolated, followed by washing and drying, and wherein said washing removes soluble surfactants.

3. A process in accordance with claim 1 wherein the dimeric acrylic acid is β-acryloxypropionic acid.

4. A process in accordance with claim 1 wherein the $M_w$ of the oligomer acrylic acid is from about 200 to about 3,500, and the $M_n$ is from about 200 to about 1,500.

5. A process in accordance with claim 1 wherein the mixture contains from about 10 to about 40 weight percent of said dimeric acrylic acid, and from about 60 to about 90 weight percent of said oligomer acrylic acid, and wherein the total of said component is about 100 percent.

6. A process in accordance with claim 1 wherein the mixture contains from about 20 to about 30 weight percent of said dimeric acrylic acid, and from about 70 to about 80 weight percent of said oligomer acrylic acid, and wherein the total of said component is about 100 percent.

7. A process in accordance with claim 2 wherein the dimeric acrylic acid is β-acryloxypropionic acid.

8. A process in accordance with claim 1 wherein the oligomeric acrylic acid is of the formula

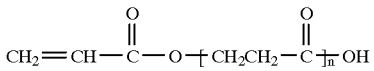

wherein n represents the number of segments.

9. A process in accordance with claim 1 wherein the monomer is a styrene containing monomer.

10. A process in accordance with claim 1 wherein the monomer is comprised of a styrene and an acrylate.

11. A process in accordance with claim 1 wherein the monomer is comprised of styrene and butyl methacrylate.

12. A process in accordance with claim 1 wherein there results subsequent to polymerization of the mixture of monomer and dimeric, and oligomer acid, or mixtures thereof a polymer, or resin.

13. A process in accordance with claim 1 wherein the polymer or resin is comprised of about 50 to about 85 weight percent of styrene, about 15 to about 35 weight percent of an acrylate, and about 0.5 to about 15 weight percent of an acrylic acid dimer and an acrylic acid oligomer, and wherein the total thereof is about 100 percent.

14. A process in accordance with claim 12 wherein the polymer is poly(styrene-butyl acrylate-alkenoic acid), poly (styrene-butadiene-alkenoic acid), poly(methyl acrylate-butadiene-alkenoic acid), poly(styrene-isoprene-alkenoic acid), or poly(styrene-butyl acrylate-acrylonitrile-alkenoic acid), and wherein said alkenoic acid is optionally alpha, beta-ethylenically unsaturated carboxylic acids selected from dimeric acrylic acid (β-acryloxypropionic acid), oligomeric acrylic acid, or mixtures thereof with acrylic acid.

15. A process in accordance with claim 1 comprising (i) preparing, or providing said aqueous colorant dispersion, which dispersion is comprised of a colorant and an ionic surfactant;

(ii) blending said colorant dispersion with said latex emulsion containing resin, which resin is generated by the polymerization of said monomer, a nonionic surfactant, and an ionic surfactant of opposite charge polarity to that of the ionic surfactant in said colorant dispersion;

(iii) heating the resulting mixture below about the glass transition temperature (Tg) of the latex resin particles to form toner sized aggregates;

(iv) heating the resulting aggregate suspension of (iii) above about the Tg of the latex resin particles in the presence of an aggregate stabilizer; and (v) cooling, followed by isolating the toner product, optionally washing, and optionally drying.

16. A process in accordance with claim 1 wherein said toner is prepared by blending said colorant dispersion with said latex emulsion by a high shearing device, and wherein the colorant contains an ionic surfactant, the latex contains a nonionic surfactant and an ionic surfactant of opposite charge polarity to that of ionic surfactant in the colorant dispersion; heating the resulting mixture at a temperature of about 30° C. to about 60° C. to effect formation of aggregates having a particle size of from about 2 to about 20 microns in volume average diameter; heating said aggregate suspension in the presence of an aggregate stabilizer to prevent, or minimize the aggregates from growing in size, and which heating is at a temperature of from about 65° C. to about 100° C.; and isolating the toner product, washing, and drying.

17. A process in accordance with claim 16 wherein the surfactant in the colorant dispersion is a cationic surfactant, and the ionic surfactant present in the latex emulsion is an anionic surfactant, or wherein the surfactant in the colorant dispersion is an anionic surfactant, and the ionic surfactant present in the latex emulsion is a cationic surfactant.

18. A process in accordance with claim 16 wherein the ionic surfactant in the colorant dispersion is a cationic surfactant, and the ionic surfactant present in the latex emulsion is an anionic surfactant.

19. A process in accordance with claim 16 wherein the heating of the latex, colorant, and surfactants in the aggregation is accomplished at temperatures of from about 15° C. to about 1° C. below the Tg of the latex resin for a duration of from about 0.5 hour to about 5 hours, and the heating of the aggregate suspension in the coalescence is conducted at about 20° C. to about 50° C. above the Tg of the latex resin for a duration of about 1 hour to about 5 hours.

20. A process in accordance with claim 1 wherein the product toner size is from about 1 to about 12 microns in volume average diameter, and said toner possesses a particle size distribution of from about 1.12 to about 1.35.

21. A process in accordance with claim 16 wherein the nonionic surfactant present in the latex emulsion is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; and wherein the anionic surfactant is selected from the group consisting of sodium dodecyl sulfate, sodium dodecylbenzene sulfate and sodium dodecyinaphthalene sulfate, wherein the anionic surfactant is selected from the group consisting of sodium dodecyl sulfate, sodium dodecylbenzene sulfate and sodium dodecyinaphthalene sulfate; and wherein the cationic surfactant is a quaternary ammonium salt.

22. A process in accordance with claim 1 wherein the latex resin is prepared by emulsion polymerization of said acrylic acid dimer, oligomer, or mixtures thereof, with vinyl monomers selected from the group consisting of styrene and substituted styrenes, 1,3-dienes, substituted 1,3-dienes, acrylates, methacrylates, acrylonitrile, acrylic acid, and methacrylic acid.

23. A process in accordance with claim 1 wherein the latex resin resulting after polymerization is selected from the group consisting of poly(styrene-butadiene-alkenoic acid), poly(methylstyrene-butadiene-alkenoic acid), poly(methyl methacrylate-alkenoic acid), poly(ethyl methacrylate-butadiene-alkenoic acid), poly(propyl methacrylate-butadiene-alkenoic acid), poly(butyl methacrylate-butadiene-alkenoic acid), poly(methyl acrylate-butadiene-alkenoic acid), poly(ethyl acrylate-alkenoic acid), poly (propyl acrylate-butadiene-alkenoic acid), poly(styrene-isoprene-alkenoic acid), poly(methylstyrene-isoprene-alkenoic acid), poly(methyl methacrylate-isoprene-alkenoic acid), poly(ethyl methacrylate-isoprene-alkenoic acid), poly (propyl methacrylate-isoprene-alkenoic acid), poly(butyl methacrylate-isoprene-alkenoic acid), poly(methyl acrylate-isoprene-alkenoic acid), poly(ethyl acrylate-isoprene-alkenoic acid), poly(propyl acrylate-isoprene-alkenoic acid), poly(styrene-propyl acrylate-alkenoic acid), poly (styrene-butyl acrylate-alkenoic acid), and poly(styrene-butyl acrylate-acrylonitrile-alkenoic acid); and wherein the alkenoic acids are alpha, beta-ethylenically unsaturated carboxylic acids selected from dimeric acrylic acid (β-acryloxypropionic acid), oligomeric acrylic acid, or mixtures thereof with acrylic acid.

24. A process in accordance with claim 2 wherein the resin size is from about 0.05 to about 1 micron in average volume diameter, and the colorant particle size is from about 0.01 to about 1 micron in volume average diameter.

25. A process in accordance with claim 1 wherein the colorant is a pigment of carbon black, magnetite, cyan, yellow, magenta pigments, or mixtures thereof.

26. A process in accordance with claim 1 wherein there is added to the surface of the formed toner metal salts, metal salts of fatty acids, silicas, metal oxides, or mixtures thereof in an amount of from about 0.1 to about 10 weight percent.

27. A process in accordance with claim 1 wherein said dimeric acrylic acid, or said oligomer acrylic acid is of the formula

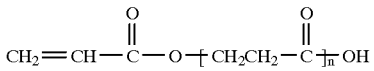

wherein n is a number of from about 1 to about 20, and wherein n is 1 for said dimeric acrylic acid, and wherein for said oligomer acrylic acid n is from about 2 to about 20.

28. A process for the preparation of toner comprising mixing a colorant and a latex polymer, and which latex polymer is generated from a monomeric dimeric acrylic acid, an oligomer acrylic acid, or mixtures thereof; heating the resulting mixture at a temperature about equal, or below about the glass transition temperature (Tg) of the latex polymer, and heating at a temperature about equal to, or above about the Tg of the latex resin.

29. A process in accordance in accordance with claim 28 wherein the oligomer is acrylic acid.

30. A process in accordance with claim 28 wherein the latex polymer is generated from said dimeric acrylic acid.

31. A process in accordance with claim 1 wherein the latex polymer is generated from a mixture of said oligomer and said dimeric acrylic acid.

32. A process in accordance with claim 16 wherein the nonionic, and ionic surfactants are each present in an amount of from about 0.01 to about 5 weight percent of the total reaction mixture.

* * * * *